United States Patent [19]

Friedman

[11] 4,040,620

[45] Aug. 9, 1977

[54] RESILIENT EXERCISE DEVICE

[76] Inventor: Stanton L. Friedman, 2285 Triway, Houston, Tex. 77043

[21] Appl. No.: 632,391

[22] Filed: Nov. 17, 1975

[51] Int. Cl.[2] ..... A63B 21/02

[52] U.S. Cl. ..... 272/137; 272/143; 272/142

[58] Field of Search ..... 272/142, 93, 94, 135, 272/116, 75, 143, 125, 137; 211/105.3; 403/349, 300

[56] References Cited

U.S. PATENT DOCUMENTS

| | | | |
|---|---|---|---|
| 2,723,121 | 11/1955 | Cartwright | 272/75 |
| 3,415,515 | 12/1968 | Otto | 272/75 |
| 3,762,704 | 10/1973 | Gingras | 272/75 |

*Primary Examiner*—Harland S. Skogquist
*Assistant Examiner*—William R. Browne
*Attorney, Agent, or Firm*—Donald Gunn

[57] ABSTRACT

An exercise device is revealed. It having an elongate solid rubber member looped into handles at each end and positioned in a hollow first tubular member. The first tubular member has ends which are telescoped into a tubular member at each handle. Pulling elongates the rubber member and separates the last mentioned tubular member from the first, enabling calibrated exercises to be performed.

5 Claims, 4 Drawing Figures

FIG. 1
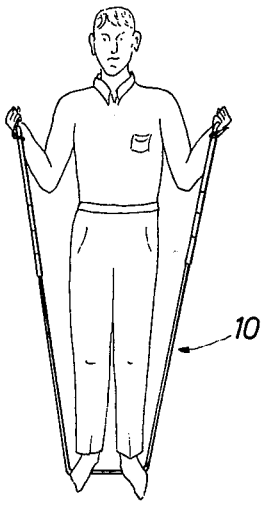
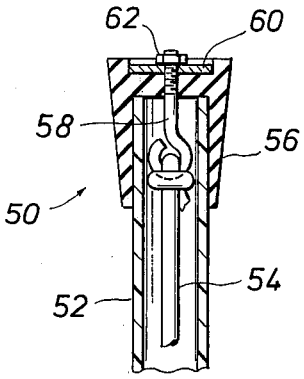
FIG. 4
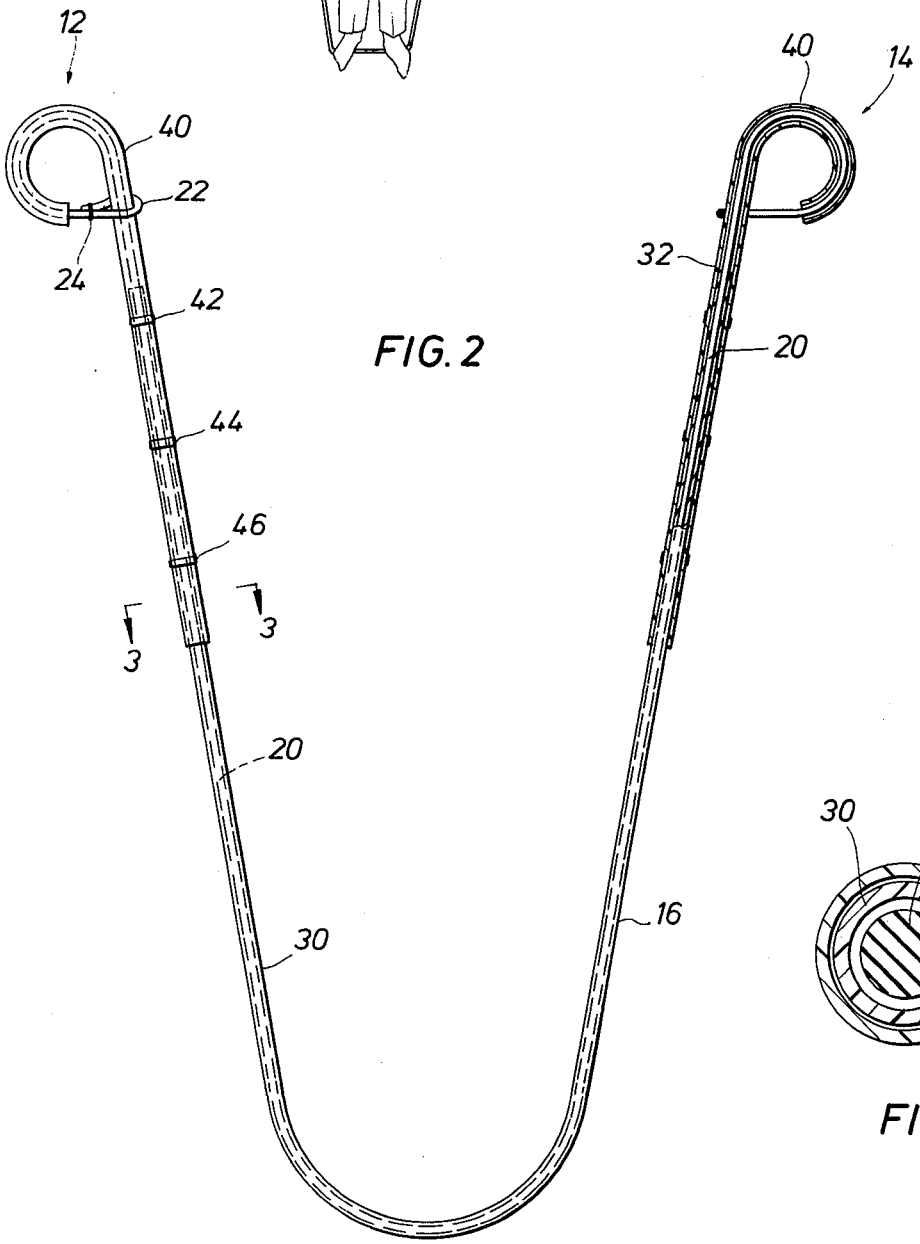
FIG. 2
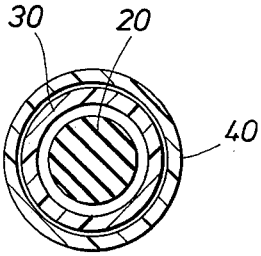
FIG. 3

RESILIENT EXERCISE DEVICE

BACKGROUND OF THE INVENTION

Many gadgets are used as exercise devices. They range from the complex pulley type devices to simple weights. By contrast, this device is profoundly simple but it is able to be installed or stored without the troubles normally associated with weights. The device is resilient, increasing the force required by the user, and thereby accomodates a number of exercise gradations. A small force can be exerted by the user when he exercises his biceps while larger muscles are opposed by larger forces in different exercises. The variety of exercises known is unlimited and each presumable must be encountered at different levels of difficulty. This device easily achieves this.

The device is easy to store. It can be rolled or looped and put in a shallow place and is flexible. The weight is minimal, thereby permitting it to be carried by a traveler.

The type of exercise required is favorable to good muscle tone. The force required to overcome the device increases as the stroke lengthens. The device provides an opposing force which the user must overcome, the force increasing with the length of the stroke of the user.

The present invention is believed advantageous over structures known in the art.

SUMMARY OF THE INVENTION

The preferred embodiment of the present invention incorporates a solid resilient elongate member typically formed of rubber. It has a degree of elongation which preferably exceeds about forty (40%) percent. The apparatus is formed of the first elongate flexible member. It is preferably solid and has a specified coefficient of stretch or flexure. The stretch or flexure provides the resistive force which the user must overcome. It is enclosed in a first tubular member, essentially of fixed length, which is preferably opaque and encompasses it, but which is shorter than the elongate member. A second tubular member at each end is formed into end loops to define handles which can easily be grasped by the user. Each handle is encircled by the second tubular member. The two second tubular members which form the handles are preferably identical. They encircle the handles and extend partly along the length of the flexible member, telescoping over the ends of the first tubular member. The two second tubular members preferably include calibration marks which are formed in the transparent material, enabling the ends or tips of the first tubular member to be viewed through the transparent tubular member. The ends serve as calibration marks, and give indication of the amount of force required by the user to overcome the flexible member.

DESCRIPTION OF THE DRAWINGS

FIG. 1 shows a person using the exerciser of the present invention to exercise his upper arms and shoulders;

FIG. 2 is an enlarged view of the exercise device showing the arrangement of first and second tubular members around the exterior of the elongate flexible member, all of which is formed into a pair of handles and having a central portion which can be optionally looped under the feet of the user or around some fixed object for easy use by the user;

FIG. 3 is a sectional view along the line 3 — 3 of FIG. 2 showing details of construction of the first and second hollow tubular members around the solid elongate member; and, FIG. 4 shows an alternative handle.

DESCRIPTION OF THE PREFERRED EMBODIMENT

The exercise device of the present invention is indicated at 10 in FIG. 1. It is shown better in FIG. 2. It includes a first handle 12 at one end and a similar handle 14 at the opposite end. The two handles separate a central portion 16 shown in FIG. 2. The handles are engaged by the user by grasping them, looping the central portion 16 either beneath his feet as shown in FIG. 1, or around some fixed object. The device is assembled as follows. It has a central elongate solid resilient member 20 shown in FIG. 3. It is preferably solid and formed of a resilient material. The resilient member 20 stretches and best has up to about forty (40%) percent stretch. It typically requires added force to attain the maximum amount of stretch. Typical synthetic rubber products can be used. The thickness can range from about one-quarter inch upward, depending on the total force desired. Thickness in the range of about one-half inch with a length of about 8 feet will suffice to exercise a typical adult male. The dimensions are representative, and can be varied to exercise to different standards.

The resilient member 20 is formed into a loop 22 which is made by doubling the resilient member back over itself and affixing a clamp 24 around it. Thin strands of a strong card can be used, including fishing line and the like. Alternatively a metal clip or staple can be placed around it. The resilient member is passed through the loop 22 to define the handle 12.

A first tubular member 30 is positioned about the flexible member 20. The tubular member 30 is preferably hollow, non-extendible, and formed with a central passage which easily permits the member 20 to stretch and flex in it. It is optionally colored and can be decorated as desired. The member 30 terminates at two ends 32 which are spaced apart from the handles 12 and 14. The are preferably provided with a contrasting color so the user can observe them as will be described.

The flexible member 30 contacts the support member which is used with the device. The support member can be the feet of the user as shown in FIG. 1. The user stands on the hollow tubular member 30. The hollow tubular member 30 does not elongate or extend. The user stands on it and pinches off about one foot to prevent its movement. This is not detrimental to the operation of the device. It is intended that the flexible member 20 stretch within the housing provided by the first tubular member. Force is applied to the handles 12 and 14 and the member 20 stretches within the tubular member 30.

The handles 12 and 14 are identically constructed. Each one incorporates a second tubular member 40. The tubular member 40 is looped around the handle, terminating just short of the eyelet 22. It is passed through the eyelet and is larger than the first tubular member 30. The tubular member 40 passes over the tubular member 30 and moves with telescoping movement relative to the end of the first tubular member. The second tubular member moves with elongation of the member 20, thereby traveling with the handles 12 and 14. The tubular member 40 is non-extendible and is preferably formed of transparent material so that the end 32 of the first tubular member 30 can be seen through it. The second tubular member 40 is preferably marked with calibration marks 42, 44, and 46. Identical marks are placed at both ends of the equipment.

In use, the user places his feet on the central portion 16 which fixes the location of the tubular member 30. The member 30 is stationary while the resilient band 20 stretches. The user grasps the handles 12 and 14 with his hands, and then lifts upwardly in repetitive motion. As he lifts upwardly, the member 20 elongates while the member 30 does not. As the user lifts upwardly, the member 20 elongates and carries the tubular members 40 upwardly away from the tubular member 30. The end of the tubular member 30 moves past the calibration marks 42, 44 and 46, depending upon the length of movement. When this occurs, the user can observe the degree of extension by observation of the calibration marks. Symmetrical extension is measured at both ends of the flexible device by use of duplicate calibration marks when the user is clamping the member 30 to the elongate member 20. The member 30 does not float to and fro on the elongate member 20.

The apparatus works equally well by looping the central portion 16 one revolution around a vertical pipe, a post, or the like. The user then can achieve exercise of a different set of muscles. The lifting exercise shown in FIG. 1 strengthens the upper arms and shoulders of the user. Looping around a pipe in front of the user exercises the upper back muscles as the user pulls facing the pipe. If the user pulls with his back to the pipe, chest muscles are exercised. It can be looped through an overhead support and downward pulling motions used. The device is normally used with symmetrical movement with both hands. Other movements can be adapted by the user as he chooses.

Representative materials are butadiene for the elongate tubular member 20. Natural rubber can also be used. Other rubber-like materials which provide a degree of elongation can also be used. Hollow neoprene tubing serves quite well for the tubular members 30 and 40.

In FIG. 4, an alternative handle is shown. Instead of a loop, the handle includes a hand held enlargement. The enlargement 50 fits around the end of a tubular member 52 which encircles the elongate stretchable member 54. The member 52 corresponds to the tubular member 40 in FIG. 2. The tubular member 52 fits inside of an enlarged rubber handle or grip 56. It is sized to enable a user to firmly hold it in his hand. It preferably fits snuggly around the tubular member 52.

On the interior of the tube 52, the stretchable member 54 is tied to an eyelet of an anchor bolt 58. The bolt 58 positions an eyelet in the center of the tube 52 from a straight shank which is supported on a load bearing disc 60 by a nut 62 threaded on the end of the bolt. The disc is embedded in a shallow circular recess in the end of the resilient enlargement 56. The thrust of the member 54 is imparted to the disc 60 and then to the resilient enlargement 56.

The enlargement 56 is provided at the end of the exercise device. It can be placed at a midpoint by equipping it with an axial opening fitting snubbly around the outer tubular member 40. Of course, in this instance, the enlargement does not need the bolt and disc.

The foregoing is directed to the preferred embodiment. The scope of the present invention is determined by the appended claims.

I claim:

1. An exercise device which incorporates a stretchable resilient member having two ends, each of which is adapted to be grasped in the hands of a user, only one central tubing member telescoped over the stretchable resilient member and extending substantially the full length of the stretchable resilient and which does not extend to the ends of said stretchable resilient member in order to expose the ends thereof, and two end tubular members respectively slidably telescoped over the ends of said central tubing member and which end tubular members are fixed relative to the exposed ends of said stretchable resilient member.

2. The apparatus of claim 1 wherein said end tubular members are looped into handles and are extended into loops and comprise a portion of said handles.

3. The apparatus of claim 2 wherein said end tubular members are transparent to enable a user to see the end of said central tubing member therethrough.

4. The apparatus of claim 3 including calibration marks on said end tubular members positioned relative to the ends of said central tubing member.

5. The apparatus of claim 4 wherein said central tubing member is color-contrasted at the end to cooperate with said end tubular members.

* * * * *